US009500988B2

(12) United States Patent
Kawasumi

(10) Patent No.: US 9,500,988 B2
(45) Date of Patent: Nov. 22, 2016

(54) DEVELOPING APPARATUS

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/923,618

(22) Filed: Oct. 27, 2015

(65) Prior Publication Data

US 2016/0116862 A1 Apr. 28, 2016

(30) Foreign Application Priority Data

Oct. 27, 2014 (JP) ..... 2014-218546

(51) Int. Cl.
*G03G 15/08* (2006.01)

(52) U.S. Cl.
CPC ..... *G03G 15/0881* (2013.01); *G03G 15/0817* (2013.01); *G03G 15/0812* (2013.01)

(58) Field of Classification Search
CPC ..... G03G 15/0881; G03G 15/0812
USPC ..... 399/103, 105
See application file for complete search history.

(56) References Cited

U.S. PATENT DOCUMENTS

| | | | | |
|---|---|---|---|---|
| 6,070,027 | A | 5/2000 | Kawai et al. | |
| 7,630,666 | B2 * | 12/2009 | Nakaya et al. | 399/103 |
| 8,843,019 | B2 * | 9/2014 | Yoshizawa et al. | 399/102 |
| 8,995,872 | B2 | 3/2015 | Ito et al. | |

FOREIGN PATENT DOCUMENTS

| | | | |
|---|---|---|---|
| JP | 11-167283 | A | 6/1999 |
| JP | 2009-069488 | A | 4/2009 |
| JP | 2010-009062 | A | 1/2010 |
| JP | 2012-211989 | A | 11/2012 |

OTHER PUBLICATIONS

Ryoichi Kawasumi, U.S. Appl. No. 14/809,396, filed Jul. 27, 2015.
Ryoichi Kawasumi, U.S. Appl. No. 14/859,804, filed Sep. 21, 2015.

* cited by examiner

*Primary Examiner* — Hoang Ngo
(74) *Attorney, Agent, or Firm* — Fitzpatrick, Cella, Harper & Scinto

(57) ABSTRACT

A developing apparatus includes a developer carrying sleeve, a container body accommodating a developer and rotatably supporting the sleeve, a cover mounted on the container body and configured to cover the sleeve, a first seal fixed to the container body and contacted to the sleeve to seal one end of the sleeve, and a second seal provided on the cover and contacted to the sleeve to seal the one end of the sleeve. The first second seals are disposed without overlapping with each other as seen in the direction of a normal line of the sleeve from a rotation axis of the sleeve. The second seal is disposed such that as seen in a rotational axis direction of the sleeve, it is outside the first seal and between the cover and the sleeve with respect to a circumferential direction of the sleeve and is overlapped with the first seal.

7 Claims, 4 Drawing Sheets

DEVELOPING APPARATUS

FIELD OF THE INVENTION AND RELATED ART

The present invention relates to a developing apparatus (device) which develops an electrostatic image on an image bearing component by causing the developer bearing component to bear developer. In particular, it relates to the structure of a sealing component which keeps sealed a developing device at both of the lengthwise ends of the developer bearing component of the developing device to prevent developer leakage.

An electrophotographic image forming apparatus has been widely used as a copying machine, a printer, a plotter, a facsimile machine, and also, as a multifunction machine which is capable of functioning as two or more of the preceding apparatuses. It employs a process which forms a visible image, which is an image formed of developer, on a sheet of recording medium, with the use of an image formation unit made up of a development unit which uses developer, a photosensitive drum unit, etc. A development unit has a development sleeve, which is disposed in the development unit to supply a photosensitive drum with developer. Developer is borne on the peripheral surface of a development sleeve. The development sleeve is rotated while bearing the developer, so that the peripheral surface of the photosensitive drum is always supplied with a fresh supply of the developer.

During the process of supplying a photosensitive drum with developer, developer has to be delivered to only a limited area in the development unit. That is, developer has to be prevented from scattering into the areas of an image forming apparatus other than the preset area. Therefore, a magnet is placed in the hollow of a development sleeve to cause the developer to be magnetically borne on the peripheral surface of the development sleeve. In addition, in order to prevent developer from scattering into the internal space of the development unit from the lengthwise ends of the development sleeve, there has been developed a development unit provided with a pair of seals which are disposed at the lengthwise ends of the development sleeve, one for one, in a manner to remain in contact with the peripheral surface of the development sleeve, so that as the development sleeve is rotated, they rub the peripheral surface of the development sleeve, preventing thereby the developer from scattering into the internal space of the development unit (Japanese Laid-open Patent Application No. 2010-9062).

This development unit is provided with a development sleeve, and a shell in which the development sleeve is rotatably held. The shell is made up of the main section, and a cover which is attached to the main section in such a manner that it covers at least a part of the development sleeve. Further, the shell has a pair of seal backing sections, to which the seals are attached with the use of adhesive. In terms of cross-section, at a plane which is perpendicular to the axial line of the developer sleeve, the sealing backing section is roughly semicircular, and is shaped so that the curvature of its inward surface matches the curvature of the peripheral surface of the development sleeve. The sealing backing section backs up the seal attached thereto so that the seal remains in contact with the peripheral surface of the development sleeve to keep sealed the interface between itself and the peripheral surface of the development sleeve.

On the other hand, it has been increasingly desired to reduce an image forming apparatus in size. Thus, it has been increasingly desired to reduce a development unit in size.

Hence, it has been desired to reduce in size the structural components of the development unit, in particular, those in the adjacencies of the seal, without interfering with the performance of the seal.

In the case of the development unit disclosed in the above-described Japanese Laid-open Patent Application No. 2010-9062, the seals are supported by only the seal backing sections of the main section of the abovementioned shell of the development unit. Thus, there is always the seal backing section between the seal, and the shell, which is on the outward side of the seal. Therefore, there has been an issue that the presence of the seal backing section between the seal and shell cover interfered with the size reduction of the development unit to a degree equivalent to the size of the seal. As for means for dealing with this issue, it is possible to divide the seal into two sections, in terms of the circumferential direction of the development roller, and attach one section to the main section of the shell, and the other to the shell cover. This means, however, is problematic in that the sections into which the seal is divided, and the portion of each section of the seal backing section of the shell, to which the seal is attached, are afforded a certain amount of dimensional tolerance, and therefore, it is possible that there will occur a gap between the two sections of the seal, or the two sections of seal will overlap (interfere with each other). With the presence of a gap between the two sections of the seal, it is possible that the developer will scatter through the gap. Further, in a case where the two sections of seal overlaps with each other, there are possibilities that the areas in which seals overlap with each other excessively increase in seal pressure and/or the assembly line for the development unit will reduce in efficiency.

Thus, the primary object of the present invention is to provide a developing device (development unit) which is significantly smaller than any conventionally structured developing device, and yet, can keep the developing device reliably sealed at the lengthwise end portions of the developer bearing component to prevent developer from leaking out of its development unit through the interface between the lengthwise end of the developer bearing component, and the seal, as well as any conventionally structured developing device.

SUMMARY OF THE INVENTION

According to an aspect of the present invention, there is provided a developing apparatus comprising a developer carrying member configured and positioned to carry developer to develop a latent image; a container body configured to accommodate the developer and to rotatably support said developer carrying member; a covering member mounted on said container body and configured to cover a peripheral surface of said developer carrying member; a first sealing member fixed to said container body and contacted to a peripheral surface of said developer carrying member to seal one end portion of said developer carrying member; and a second sealing member provided on said covering member and contacted to the peripheral surface of said developer carrying member to seal said one end portion of said developer carrying member; wherein said first sealing member and said second sealing member are disposed so as not to overlap with each other as seen in the direction of a normal line of said developer carrying member from a rotation axis of said developer carrying member, and wherein said second sealing member is disposed at such a position that as seen in a rotational axis direction of said developer carrying member, said second sealing member is outside the first sealing member and between said covering member and said developer carrying member with respect to a circumferential direction of said developer carrying member and is overlapped with said first sealing member.

Further features of the present invention will become apparent from the following description of exemplary embodiments with reference to the attached drawings.

Figure 4:
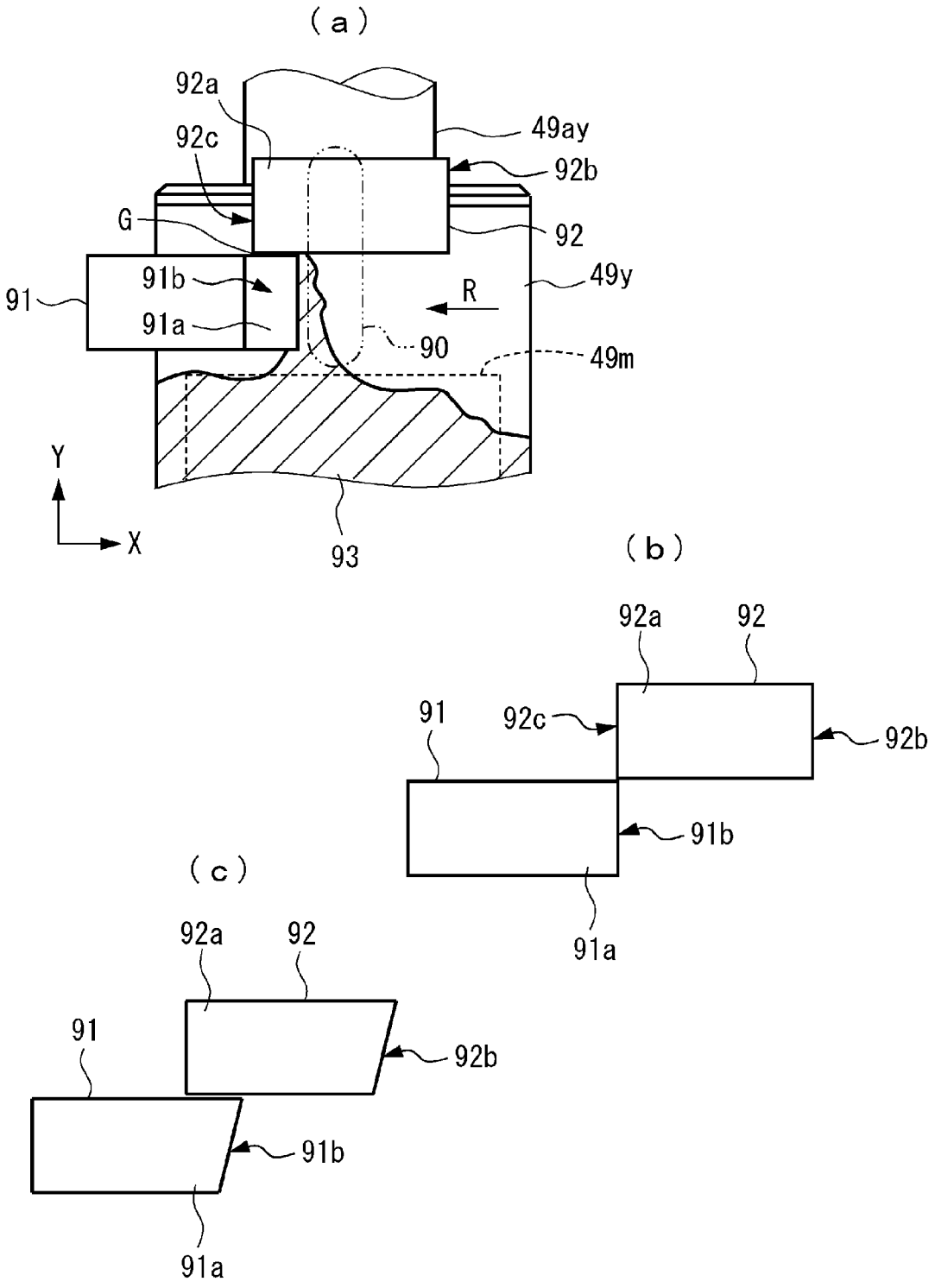

Parts (a), (b) and (c) of FIG. 4 are plan views of one of the lengthwise ends of the developer bearing component of the development unit of the developing device of the image forming apparatus, which is in accordance with the present invention. They show the positioning of the two sections of the development unit seal, relative to the development sleeve, part (a) of FIGS. 4, 4(*b*) and 4(*c*) showing a case in which the two sections of the seal are made to overlap with each other as seen from their widthwise direction, a case in which the two sections are positioned so that the inward surface of the outer section aligns with the outward surface of the inner section, and a case in which the upstream surface of each section in terms of the rotational direction of the development sleeve, is angled, respectively.

DESCRIPTION OF THE EMBODIMENTS

Hereinafter, one of the preferable embodiments of the present invention is described in detail with reference to FIGS. 1-4. By the way, this embodiment is described with reference to a full-color printer of the so-called tandem type, which is an example of image forming apparatus. However, the application of the present invention is not limited to an image forming apparatus of the so-called tandem type. That is, the present invention is also applicable to an image forming apparatus other than an image forming apparatus of the tandem type. Further, the application of the present invention is not limited to a full-color image forming apparatus. That is, the present invention is also applicable to a black-and-white image forming apparatus, and a monochromatic image forming apparatus.

Figure 1:
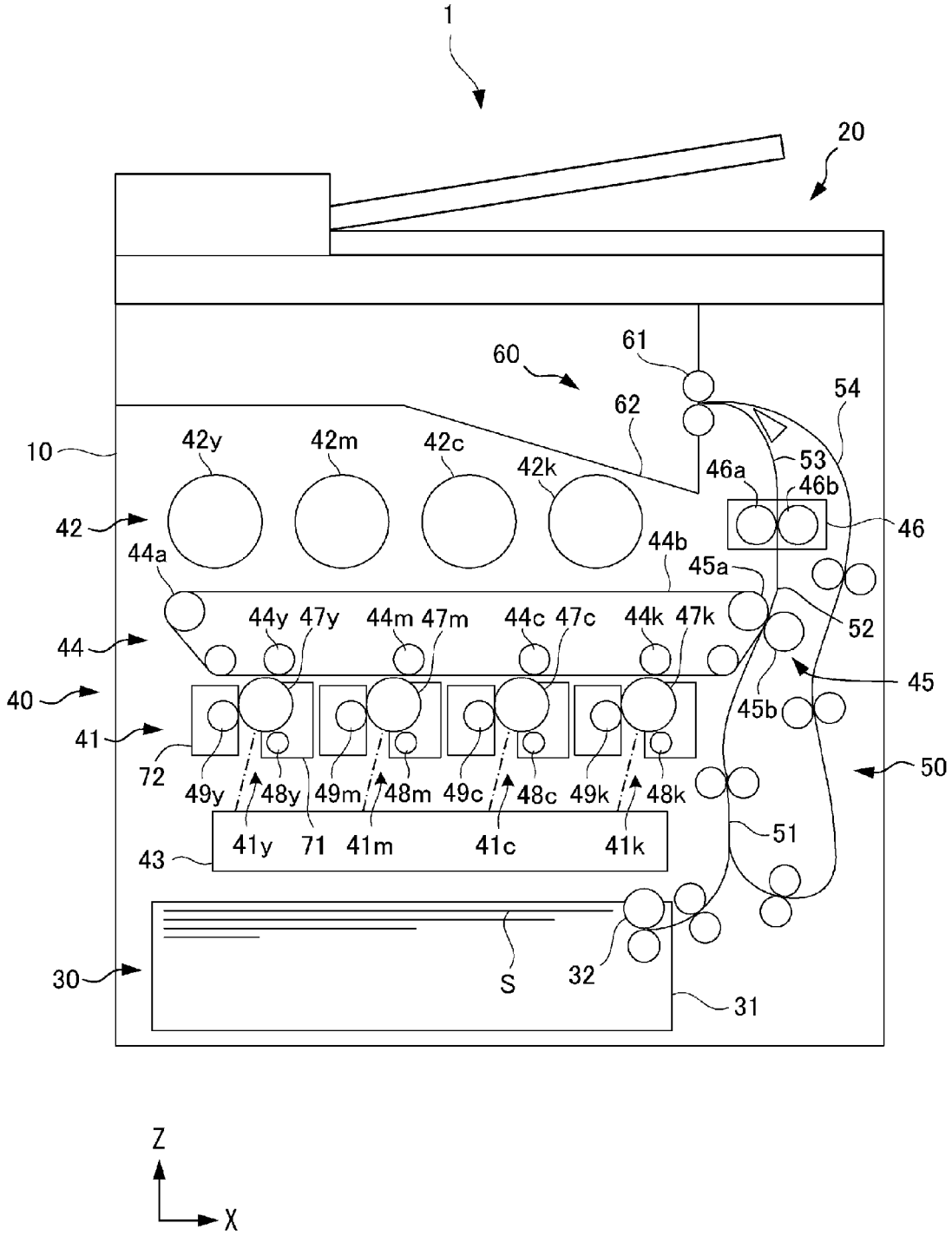
FIG. 1 is a schematic sectional view of a typical image forming apparatus to which the present invention is applicable.

Referring to FIG. 1, an image forming apparatus 1 has a main assembly 10 (which hereafter will be referred to as apparatus main assembly). The apparatus main assembly 10 has an image reading section 20, a sheet feeding-conveying section 30, an image forming section 40, a sheet conveying section 50, a sheet discharging section 60, and an unshown controlling section. By the way, a sheet S is recording medium on which a toner image (image formed of toner) is formed. Examples of recording medium are a sheet of ordinary paper, a sheet of synthetic resin which can be used in place of a sheet of ordinary paper, a sheet of cardstock, a sheet of film for an overhead projector, and the like.

The image reading section 20 is a part of the top portion of the apparatus main assembly 10. It has an unshown platen glass where an original is placed, an unshown light source for projecting a beam of light upon an original on the platen glass, an unshown image sensor which converts the beam of light reflected by the original, into digital signals, etc.

The sheet feeding-conveying section 30 is a part of the bottom portion of the apparatus main assembly 10. It has a sheet cassette 31 in which multiple sheets S of recording medium are stored in layers, and a conveyance roller 32. It conveys a sheet S of recording medium to the image forming section 40.

The image forming section 40 has an image formation unit 41, a toner bottle 42, a laser scanner 43, an intermediary transfer unit 44, a secondary transferring section 45, and a fixing device 46. It forms images.

The image formation unit 41 has four subunits 41*y*, 41*m*, 41*c* and 41*k* which are for forming yellow (y), magenta (m), cyan (c) and black (k) monochromatic color images, respectively. These subunits are removably installable into the apparatus main assembly 10 by a user. For example, the image formation subunit 41*y* has a photosensitive drum 47*y* which is an image bearing component on which a toner image is formed, a charge roller 48*y*, a development sleeve 49*y* (developer bearing component), an unshown drum cleaning blade, toner, etc. To the image formation subunit 41*y*, toner is supplied from the toner bottle 42*y* filled with toner. By the way, the image formation subunit 41*y* has a photosensitive component unit 71 and a development unit 72 (developing device). By the way, the other image formation subunits 41*m*, 41*c* and 41*k* are the same in structure as the image formation subunit 41*y*, although the four subunits are different in the color of the toner they use. Therefore, they are not described in detail here.

The laser scanner 43 is an exposing means for exposing the peripheral surface of each of the photosensitive drums 47*y*, 47*m*, 47*c* and 47*k* to form an electrostatic latent image on the peripheral surface of each photosensitive drum 47.

The intermediary transferring unit 44 is on top of the image formation unit 41. It has multiple rollers, more specifically, a driver roller 44, primary transfer rollers 44*y*, 44*m*, 44*c* and 44*k*, etc., and an intermediary transfer belt 44*b* suspended by these rollers. The primary transfer rollers 44*y*, 44*m*, 44*c* and 44*k* are disposed in contact with the intermediary transfer belt 44*b* in such a manner that they oppose the photosensitive drums 47*y*, 47*m*, 47*c* and 47*k*, respectively, with the presence of the intermediary transfer belt 44*b* between themselves and photosensitive drums. A transfer bias, which is positive in polarity, is applied to the intermediary transfer belt 44*b* by the primary transfer rollers 44*y*, 44*m*, 44*c* and 44*k*, and the toner images which are on the photosensitive drums 47*y*, 47*m*, 47*c* and 47*k*, respectively, and which are negative in polarity, are sequentially transferred in layers onto the intermediary transfer belt 44*b*. Consequently a full-color image is effected on the intermediary transfer belt 44*b*.

The secondary transferring section 45 has a secondary transfer inner roller 45*a* and a secondary transfer outer roller 45*b*. As the secondary transfer bias, which is positive in polarity, is applied to the secondary transfer outer roller 45*b*, the full-color image effected on the surface of the intermediary transfer belt 44*b* is transferred onto a sheet S of recording medium. By the way, the secondary transfer inner roller 45*a* is inside the loop which the intermediary transfer belt 44*b* forms. It is one of the rollers by which the intermediary transfer belt 44*b* is suspended. It is disposed so that it opposes the secondary transfer outer roller 45*a*, with the presence of the intermediary transfer belt 44*b* between the two rollers 45*a* and 45*b*.

The fixing device 46 is provided with a fixation roller 46*a* and a pressure roller 46*b*. After the transfer of the full-color toner image onto a sheet S of recording medium, the sheet S is conveyed between the fixation roller 46*a* and pressure roller 46*b*, while remaining pinched between the two rollers 46*a* and 46*b*. While the sheet P is conveyed between the two rollers 46*a* and 46*b*, the toner image on the sheet S is subjected to heat and pressure, being thereby fixed to the sheet S. The fixing device 46 is unitized, so that it can be installed into, or uninstalled from the apparatus main assembly 10.

As a sheet S of recording medium is conveyed to the sheet conveying section 50, from the sheet feeding-conveying section 30, the sheet conveying section 50 conveys the sheet S to the sheet discharging section 60 by way of the image forming section 40. The sheet conveying section 50 has a pre-secondary transfer conveyance passage 51, a pre-fixation conveyance passage 52, a discharge passage 53, and reconveyance passage 54.

The sheet discharging section 60 has a pair of discharge rollers 61, which are disposed on the downstream side of the discharge passage 53, and a delivery tray 62 which is disposed on the downstream side of the pair of discharge rollers 61. The delivery tray 62 is the so-called face-down tray. That is, as a print is discharged from the apparatus main assembly 10, the print is placed on top of the preceding prints in the delivery tray 62, in such an attitude that the image bearing surface of the sheet S faces downward. By the way, there is an empty space between the image reading section 20 and delivery tray 62.

The control section is made up of a computer. It has a CPU, a ROM in which programs for controlling each of various sections of the image forming apparatus are stored, a RAM in which data are temporarily stored, and an input-output circuit through which signals are inputted into the control section from external devices, or signals are outputted from the image forming apparatus to the external devices. The control section is in connection to the image reading section 20, sheet feeding-conveying section 30, image forming section 40, sheet conveying section 50, and sheet discharging section 60, through the output-input circuit. Not only does it exchange signals with each of the abovementioned various sections, but also, controls their operation. Further, the control section is configured so that it can control the image forming apparatus based on the commands from an unshown computer which is in connection to the apparatus, and also, so that an operator can operate, and/or set the conditions under which the image forming apparatus is to be operated, with the use of an unshown control panel of the apparatus.

Next, the image forming operation of the image forming apparatus 1 structured as described above is described.

As an image forming operation is started, first, the photosensitive drum 47*y*, 47*m*, 47*c* and 47*k* begin to be rotated. As the photosensitive drums 47 are rotated, their peripheral surface is charged by the charge rollers 48*y*, 48*m*, 48*c* or 48*k*. Then, a beam of laser light is emitted from the laser scanner 43 upon the peripheral surface of each of the photosensitive drums 47*y*, 47*m*, 47*c* and 47*k*, while being modulated according to the image information. Consequently, an electrostatic latent image is formed on the peripheral surface of each of the photosensitive drums 47*y*, 47*m*, 47*c* and 47*k*. As toner adheres to this electrostatic latent image, the latent image develops into a visible image, that is, an image formed of toner (developer), which hereafter may be referred to as a toner image. The toner image is transferred onto the intermediary transfer belt 44*b*.

Meanwhile, the sheet feeder roller 32 is rotated in synchronism with the progression of the toner image formation. Thus, the topmost sheet S of recording medium in the sheet cassette 31 is fed into the apparatus main assembly 10 while being separated from the rest of sheets in the cassette 31. Then, the sheet S is conveyed to the secondary transferring section 45 through the pre-secondary transfer conveyance passage 51, with such a timing that it is delivered to the secondary transferring section 45 at the same time as the toner image on the intermediary transfer belt 44*b*. Then, the toner image is transferred from the intermediary transfer belt 44*b* onto the sheet S. Then, the sheet S is conveyed to the fixing device 46, in which the unfixed toner image on the sheet S is heated and pressed. Thus, the unfixed toner image becomes fixed to the surface of the sheet S. Then, the sheet S is discharged into the delivery tray 62 by the pair of discharge rollers 61, in such a manner that the sheet is layered on top of the preceding sheets S in the tray 62.

Next, referring to FIGS. 1-4, the image formation unit 41*y*, in particular, the development unit 72 of the image formation unit 41*y*, is described in detail. By the way, in this embodiment, the direction in which toner is conveyed, that is, the rotational direction of the development sleeve 49*y*, is referred to as a direction R (developer conveyance direction), and the direction which is intersectional (perpendicular, here) to the direction R is referred to as direction Y (widthwise direction). Further, the left-right direction of the image formation unit 41*y* (development unit 72), as seen from the front side of the apparatus main assembly 10, is referred to as direction X, and the vertical direction, that is, the direction perpendicular to the direction X, is referred to a direction Z.

Referring to FIG. 1, the image formation unit 41*y*, for example, has the photosensitive drum unit 71 and development unit 72. The photosensitive drum unit 71 has photosensitive drum 47*y*, charge roller 48*y*, and an unshown drum cleaning blade of the image formation unit 41*y*. The photosensitive drum unit 71 is configured so that the photosensitive drum 47*y* is exposed upward from the photosensitive drum unit 71, in such a manner that it is enabled to contact the intermediary transfer belt 44*b*. The structure of this photosensitive drum unit 71 is the same as the structure of a conventional known photosensitive drum unit, and therefore, is not described in detail here.

Figure 2:
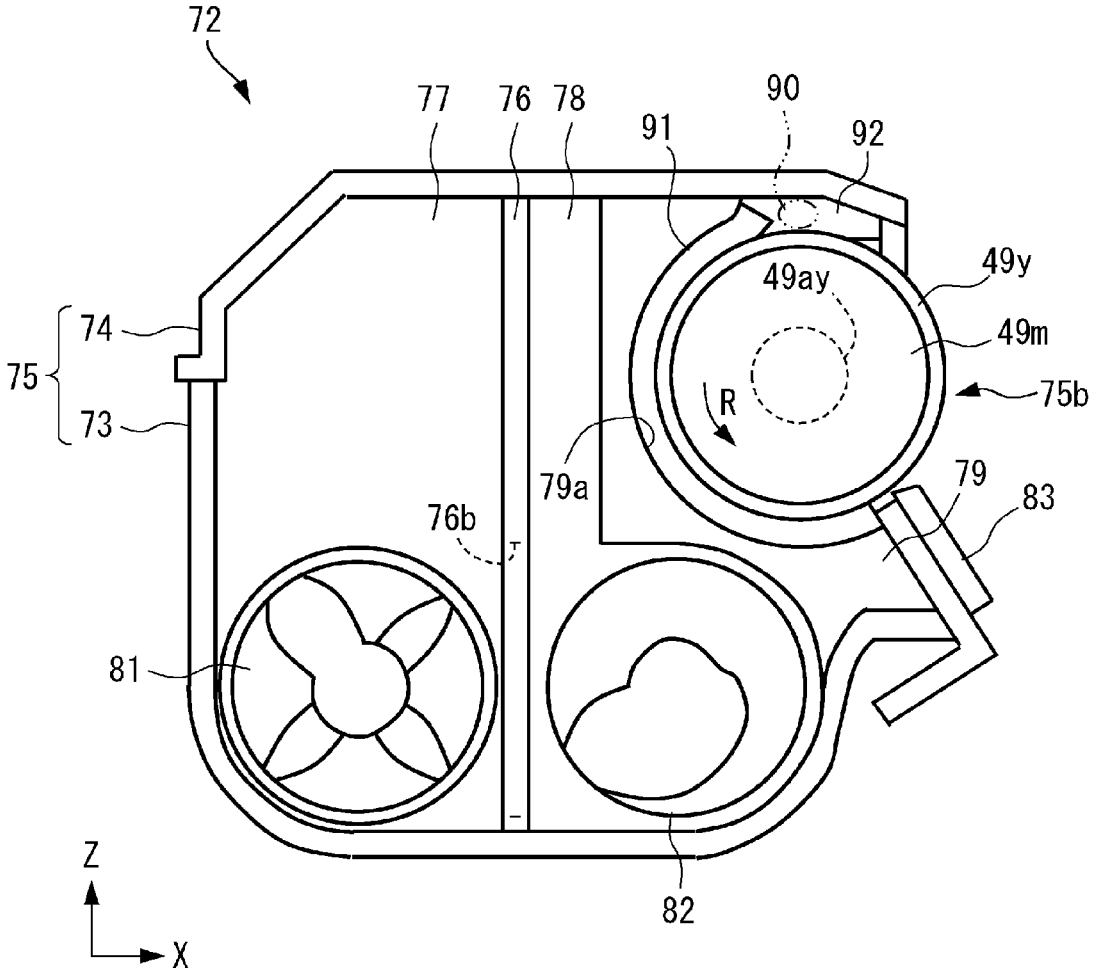
FIG. 2 is a schematic sectional view of the developing device which is in accordance with the present invention, and which is employable by an image forming apparatus.
Figure 3:
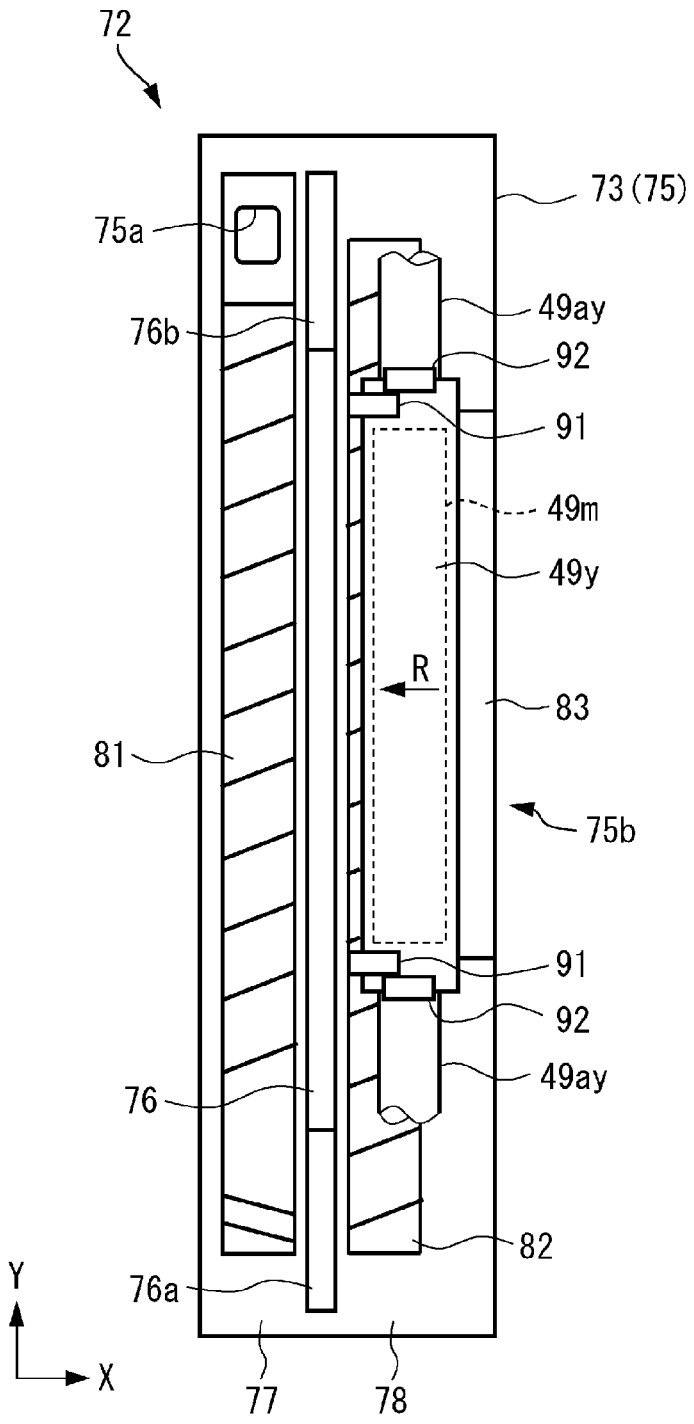
FIG. 3 is a plan view of the developing device of the image forming apparatus, which is in accordance with the present invention, after the removal of the cover of the shell of the developing device.

Next, referring to FIGS. 2 and 3, the development unit 72 has a housing 75 which is made up of a main section 73 and a cover section 74. The main section 73 is in the form of an open box. The cover section 74 is attached to the main section 73. The main section 73 is structured so that it rotatably holds the development sleeve 49*y*, and also, stores developer. The cover section 74 is structured so that as it is attached to one of the top edges of the main section 73 of the housing 75, it covers at least a part of the development sleeve 49*y*. There is a partition wall 76 in the housing 75. The lengthwise direction of the partition wall 76 is parallel to the direction Y. The housing 75 has a stirring chamber 77, and a development chamber 78 partitioned from the stirring chamber 77 by the partition wall 76. The stirring chamber 77 and development chamber 78 are in connection to each other through a pair of developer passages 76*a* and 76*b*.

There is the first conveyance screw 81, in the stirring chamber 77. The first conveyance screw 81 is rotatable. As toner is conveyed into the stirring chamber 77 from the toner bottle 42*y* through a toner delivery opening 75*a*, the first conveyance screw 81 conveys the toner to the developer passage 76*a* while stirring the combination of the fresh supply of toner and the used developer, in the stirring chamber 77, and conveys the combination of the toner and carrier into the development chamber 78 through the developer passage 76*a*.

In the development chamber 78, the second conveyance screw 82, and development sleeve 49*y* are rotatably disposed in parallel to the first conveyance screw 81. As the developer (combination of toner and carrier) is conveyed into the development chamber 78 through the developer passage 76*a*, the second conveyance screw 82 conveys the developer in the opposite direction from the developer conveyance direction of the first conveyance screw 81, into the stirring chamber 77 through the developer passage 76*b*. That is, the developer is circularly moved in the development unit 72 through the stirring chamber 77, developer passage 76*a*, development chamber 78, and developer passage 76*b*.

The development sleeve 49*y* is provided with a pair of shafts 49*ay*, which are attached to the lengthwise ends of the development sleeve 49*y*, one for one, and which are rotatably supported by the main section 73 of the housing developing means container 75 of the development unit 72. The development sleeve 49*y* is rotatably disposed in the development chamber 78 in such a manner that its peripheral surface is partially exposed toward the photosensitive drum 47*y* (FIG. 1) through an opening 75*b* with which the housing 75 is provided. The development unit 72 is also provided with a development blade 83 (component for regulating developer layer in thickness), which is below the opening 75*b*, extending along the peripheral surface of the development sleeve 49*y*.

The development sleeve 49*y* is rotationally driven by an unshown driving mechanism in the direction R. As it is driven, it bears the developer, and conveys the developer to the photosensitive drum 47*y*. There is a stationary magnet 49*m* in the hollow of the development sleeve 49*y*. The magnet 49*m* is fixed to the housing 75. As the developer is conveyed, while being stirred, through the stirring chamber 77 and development chamber 78, the toner becomes negatively charged, whereas the carrier becomes positively charged. Then, the developer is made to be borne on the peripheral surface of the development sleeve 49*y* by the magnetic force of the magnet 49*m*, and is conveyed by the development sleeve 49*y*. As the layer of developer borne on the peripheral surface of the development sleeve 49*y* is conveyed past the development blade 83, the developer layer is regulated in thickness, and then, is conveyed to the photosensitive drum 47*y*.

Next, referring to FIG. 2, the development sleeve 49*y* is supported in the top portion of the housing 75. Also referring to FIG. 2, the narrow gap between the cover section 74 of the housing 75, which is attached to the main section 73 of the housing 75, and the peripheral surface of the development sleeve 49*y*, will be referred to as a close contact area 90. In this embodiment, the close contact area 90 is where the gap between the peripheral surface of the development sleeve 49*y* and the cover section 74 is narrowest.

Referring to FIG. 3, the development unit 72 is provided with two pairs of the first and second seals 91 and 92, which are located at the lengthwise ends of the development sleeve 49*y*, one for one. By the way, in this embodiment, two pairs of a combination of the first and second seals 91 and 92, which are located at the lengthwise ends of the development sleeve 49*y*, one for one, are the same in structure except that they are symmetrically positioned to each other, with reference to a plane which is perpendicular to the axial line of the development sleeve 49*y* and coincides with the center of the axial line of the development sleeve 49*y*. Therefore, in the following description of this embodiment, one of the two pairs of the combination of the first and second seals 91 and 92, more specifically, the top pair (top side in FIG. 3) of the first and second seals 91 and 92 are described in detail.

Next, referring to FIGS. 2-4, the first seal 91 is fixed to the main section 73, of the housing 75, and seals between the development sleeve 49*y* and the main section 73 to prevent the developer 93 (part (a) of FIG. 4) from leaking out of the development unit 72 in the widthwise direction. As the first seal 91 which is placed in contact with the development sleeve 49*y*, an ordinary seal of the contact type formed of foamed substance, such as a piece of foamed urethane, felt, or the like, may be used as desired.

The main section 73 of the housing 75 is provided with a supporting section 79 which backs up the first seal 91. The supporting section 79 is shaped so that as it is seen from its widthwise direction, its inward surface 79*a*, that is, the surface of the supporting section 79, which faces the development sleeve 49*y*, roughly semicircularly concaves away from the opening 75*b*. Further, the supporting section 79 is shaped so that its inward surface 79*a* concaves in such a curvature that after the assembly of the development unit 72, there will be a uniform gap between the inward surface 79*a* of the supporting section 79 and the peripheral surface of the development sleeve 49*y*, and also, so that the inward surface 79*a* circumvents the development sleeve 49*y* roughly 180° from the top side of the development sleeve 49*y* to the bottom side. It is to this inward surface 79*a* that the first seal 91 is fixed with the use of adhesive.

As the first seal 91 and supporting section 79 are seen from the direction of the rotational axis of the development sleeve 49*y*, they are outside, in terms of the direction R, the close contact area 90 where the gap between the cover section 74 and the peripheral surface of the development sleeve 49*y* is smallest. That is, the supporting section 79 by which the first seal 91 is supported is positioned outside the close contact area 90, in terms of the direction R, in such a manner that a preset amount of distance is provided between the inward surface of the supporting section 79 and the peripheral surface of the development sleeve 49*y*. In this embodiment, in terms of the circumferential direction of the development sleeve 49*y*, a roughly half (roughly 180°) of the interface between each of the lengthwise end portions of the development sleeve 49*y*, and the main section 73 of the housing 75, is sealed with the first seal 91 which is placed in contact with the peripheral surface of the development sleeve 49*y* in such a manner that the development sleeve 49*y* is allowed to rotate while remaining in contact with the first seal 91. In other words, the first seal 91 is disposed in contact with at least a part of the peripheral surface of the development sleeve 49*y*, which excludes the portion which corresponds to the close contact area 90. As described above, the first seal 91 and supporting section 79 are outside the close contact area 90 in terms of the direction R. Therefore, it was possible to reduce the development unit 72 in size, by reducing the distance between the cover section 74 of the housing 75 of the development unit 72, and development sleeve 49*y*, in the close contact area 90. By the way, in this embodiment, a small gap is provided between the upstream end of the first seal 91 in terms of the direction R, and the development sleeve 49*y* (FIG. 2). However, this embodiment is not intended to limit the present invention in scope in terms of the positional relationship between the end portion of the first seal 91, in terms of the direction R, and the peripheral surface of the development sleeve 49*y*. That is, the development unit 72 may be structured so that the entirety (including upstream end portion) of the inward surface of the first seal 91 is in contact with the peripheral surface of the development sleeve 49*y*.

The second seal 92 is fixed to the back surface (downwardly facing surface) of the cover section 74 of the housing 75, with the use of adhesive, in order to seal between the development sleeve 49*y* and cover section 74 to prevent the developer 93 from leaking out of the development unit 72, in the widthwise direction of the second seal 92. As the second seal 92, an ordinary seal of the contact type formed of foamed substance, such as a piece of foamed urethane, felt, or the like, may be used as desired, as in the case of the first seal 91. The first seal 91 and second seal 92 may be the same in material, or different.

The first and second seals 91 and 92 are disposed so that as the first and second seals 91 and 92 are seen in the direction parallel to the direction R, they do not overlap with each other (as first and second seals 91 and 92 are seen in the direction parallel to generatrix of development sleeve 49*y*, from the center of rotational axis of development sleeve 49*y*, they overlap with each other). Further, with regard to the positioning of the first and second seals 91 and 92 in the close contact area 90, in terms of the circumferential direction of the development sleeve 49*y*, the second seal 92 is disposed in such a manner that as it is seen in the direction R, it is on the outward side of the first seal 91, whereas as it is seen in its widthwise direction, it overlaps with the 91. That is, the second seal 92 is disposed in contact with the peripheral surface of the development sleeve 49*y* in such a manner that it contacts at least a part of the peripheral surface of the development sleeve development sleeve 49*y*, which includes the portion which corresponds to the close contact area 90.

Referring to part (a) of FIG. 4, the first and second seals 91 and 92 are disposed so that as they are seen from their widthwise direction, the upstream end portion 91*a* of the first seal 91 in terms of the direction R, overlaps with the downstream end portion 92*a* of the second seal 92 in terms of the direction R. By the way, the "end portion 91*a* of the first seal 91" means the portion of the first seal 91, which can function, as a sealing portion of the first seal 91, by contacting the development sleeve 49*y*. That is, the development unit 72 is structured so that as the end portion 91*a* of the first seal 91, which is in contact with the development sleeve 49*y*, and the end portion 92*a* of the second seal 92, which is in contact with the development sleeve 49*y*, are seen from their widthwise direction, no gap can be seen between the two end portions 91*a* and 92*a*. By the way, the upstream surface 91*b* of the first seal 91 in terms of the direction R, and the upstream surface 92*b* of the second seal 92 in terms of the direction R, are both parallel to the widthwise direction of the first and second seals 91 and 92.

The second seal 92 is disposed in the close contact area 90. Therefore, it can keep sealed the gap between the cover section 74 of the housing 75, and development sleeve 49*y*, in the close contact area 90, even though the first seal 91 is not disposed in the close contact area 90. Further, the second seal 92 is attached to the back surface of the cover section 74, with the use of adhesive. Therefore, unlike the first seal 91, it does not require a supporting component such as the supporting section 79 for the first seal 91. That is, the gap between the cover section 74 and development sleeve 49*y* in the close contact area 90 does not need to be large enough to accommodate a seal supporting component. Therefore, the development unit 72 can be smaller in size.

In this embodiment, in consideration of the tolerance in the process of assembling the housing 75 (process of attaching cover section 74 to main section 73), and the tolerance in the process of attaching the first seal 91 and second seal 92 to the supporting section 79 and cover section 75, respectively, where the first and second seals 91 and 92 are to be attached with the use of adhesive are determined as follows.

First, where the first seal 91 and second seal 92 are to be attached with the use of adhesive are determined, in consideration of the combination (which hereafter will be referred to as overall tolerance) of the tolerance in the process of attaching the cover section 74 to the main section 73, and the tolerance in the process of attaching the first and second seals 91 and 92, so that the two seals 91 and 92 do not overlap with each other in terms of the direction R. For example, it is assumed here that the first and second seals 91 and 92 have a positional deviation of ±1 mm because of the overall tolerance. In this case, a position which is 1 mm away from the position at which the lateral surface of the first seal 91 and the lateral surface of the second seal 92 contact with each other, in terms of the widthwise direction of the two seals seal 91 and 92, is set as the referential position. By choosing (determining) the referential position for the first and second seals 91 and 92 as described above, it is possible to prevent the first and second seals 91 and 92 from interfering (overlapping) with each other in terms of the direction R, even if the first and second seals 91 and 92 exceed in the maximum amount of positional deviation because of the overall tolerance.

It is also assumed here that it is possible that the first and second seals 91 and 92 will exceed ±1 mm, for example, in the positional deviation in terms of the direction R because of the overall tolerance. In this case, a position which is downstream by 1 mm in the direction R from where the downstream end surface 92*c* of the second seal 92 in the direction R coincides the upstream end surface 91*c* of the first seal 91 in the direction R is selected as the referential position. With this selection, even if the positional deviation of the first seal 91 and that of the second seal 92 exceed the maximum value of 1 mm in terms of the direction R because of the overall tolerance, it is possible to position the first and second seals 91 and 92 in such a manner that as they are seen from their widthwise direction, there is no gap between the first and second seals 91 and 92.

By the way, in the process of assembling the development unit 72, the first seal 91 is attached in advance to the inward surface 79*a* of the supporting section 79 of the main section 73 of the housing, with the use of adhesive, and then, the second seal 92 is attached in advance to a preset portion of the back side (inward side) of the cover section 74, with the use of adhesive. Then, the development sleeve 49*y*, and first conveyance screw 81, and second conveyance screw 82 are attached to the main section 73. Then, the cover section 74 is attached to the main section 73. With the use of this process, it is possible to position the first and second seals 91 and 92 so that they are properly positioned relative to each other.

Next, referring to FIGS. 2-4, the first and second seals 91 and 92 are described in detail about their function.

First, referring to FIGS. 2 and 3, when the image formation unit 41*y* is in operation, toner is supplied to the stirring chamber 77 through the developer passage 75*a*, and then, is conveyed to the developer passage 76*a* by the first conveyance screw 81 while being stirred along with the developer in the stirring chamber 77. Then, the mixture of the fresh supply of toner and the used developer, in the stirring chamber 77 is conveyed into the development chamber 78 through the development passage 76*a*, and then, is conveyed by the second conveyance screw 82 toward the developer passage 76*b* along the peripheral surface of the development sleeve 49*y* while being stirred by the second conveyance screw 82. The development sleeve 49*y* rotates in the direction R. As the development sleeve 49*y* rotates, a part of the developer in the development chamber 78 is made to be borne on the peripheral surface of the development sleeve 49*y* by the magnetic force (developer (carrier) attracting force) of the magnet 49*m*.

Next, referring to part (a) of FIG. 4, across the lengthwise end portion of the development sleeve 49*y*, a part of the developer 93 on the peripheral surface of the development sleeve 49*y* tends to move outward in terms of the widthwise direction. As the part of the developer 93 moves outward, it comes into contact with the lateral portion of the first seal 91. However, the first seal 91 is in contact with the peripheral surface of the development sleeve 49*y*, preventing thereby the developer from moving outward in the widthwise direction of the first seal 91, beyond the inward lateral surface of the first seal 91. That is, the development unit 72 remains sealed in terms of developer leakage. On the other hand, there is no seal on the upstream side of the first seal 91 in terms of the direction R. Therefore, it is possible that the developer will scatter upstream. However, the development sleeve 49*y* is rotating in the direction R at a high speed. Therefore, as the developer 93 scatters upstream of the first seal 91, it is made to come into contact with the end portion 91*a* of the first seal 91, in the circumferential direction of the development sleeve 49*y*, by the rotation of the development sleeve 49*y*. That is, as the developer 93 scatters upstream, it is recovered by the first seal 91, and is borne again by the development sleeve 49*y* by being attracted by the magnet 49*m*.

Further, a part of the developer 93 recovered on the upstream side of the first seal 91 in terms of the direction R, tends to scatter outward in terms of the widthwise direction of the first seal 91. However, as the first and second seals 91 and 92 are seen from their widthwise direction, the end portion 91*a* of the first seal 91 and the end portion 92*a* of the second seal 92 overlap with each other. In addition, as the developer 93 scatters outward, it comes into contact with the inward lateral surface of the second seal 92, being thereby prevented from scattering outward beyond the second seal 92. As the developer 93 comes into contact with the inward surface of the second seal 92, it moves through the gap G between the first and second seals 91 and 92, in the direction R, and is made to rotate once in the direction R, by the rotation of the development sleeve 49*y*. As the developer 93 rotates once in the direction R, it is made, by the end portion 91*a* of the first seal 91, to join the developer 93 having been recovered by the end portion 91*a*.

As described above, in the case of the development unit 72 in this embodiment, the first seal 91 is on the outward side, in terms of the lengthwise direction, of the close contact area 90, that is, the area where the gap between the development sleeve 49*y* and cover section 74 of the housing 75 is smallest. Therefore, it is unnecessary for a part of the main section 73 of the housing 75 to be placed between the first seal 91 and cover section 74. Therefore, the development unit 72 in this embodiment is smaller in size than a conventional development unit structured so that the seal supporting section 79 of its main section 73 has to be between the first seal 91 and cover section 74. That is, this embodiment can reduce the development unit of a developing device in size.

Further, the development unit 72 in this embodiment is structured so that the second seal 92 is staggered relative to the first seal 91 in the widthwise direction in such a manner that as the first and second seals 91 and 92 are seen from the direction R, no gap can be seen between the first and second seals 91 and 92. Therefore, the development unit 72 remains sealed between the cover section 74 and the peripheral surface of the development sleeve 49*y* like a development unit structured so that the first seal 91 backed up by the main section 73 extends into the close contact area 90. That is, according to this embodiment, it is possible to reduce a development unit in size while keeping the developing unit reliably sealed at the lengthwise ends of the development sleeve 49*y*.

Further, the development unit 72 in this embodiment is structured so that the first and second seals 91 and 92 are disposed in such a manner that as the first and second seals 91 and 92 are seen from the widthwise direction, at least a part of the first seal 91 and at least a part of the second seal 92 overlap with each other in the direction R. Therefore, the developer is prevented from scattering in the widthwise direction through the gap between the first and second seals 91 and 92 in terms of the direction R. Thus, it is ensured that the developer is prevented by the coordination of the first and second seals 91 and 92, from scattering into the internal space of the image forming apparatus.

Further, the development unit 72 in this embodiment is structured so that the second seal 92 is positioned on the outward side of the first seal 91 in terms of the widthwise direction. Therefore, the development unit 72 is higher in developer recovery efficiency, being therefore better sealed in terms of developer leakage, than a development unit structured so that the second seal 92 is positioned on the inward side of the first seal 91 in terms of the widthwise direction.

Further, the development unit 72 in this embodiment is structured so that the upstream end surfaces 91*b* and 92*b* of the first and second seals 91 and 92, respectively, in terms of the direction R, become parallel to the widthwise direction. That is, the first and second seals 91 and 92 in this embodiment are simpler in shape, being therefore easier to manufacture, and easier to attach to the main section 73 or cover section 74 of the housing 75. Thus, the development unit 72 in this embodiment is higher in the efficiency with which the first and second seals 91 and 92 are attached to the main section 73 or cover section 74, with the use of adhesive, than a conventional development unit.

Further, the first and second seals 91 and 92 employed by the development unit 72 in this embodiment are seals of the contact type, which seal between the cover section 74 and development sleeve 49*y* to prevent the developer leakage, by being placed in contact with the development sleeve 49*y*. Therefore, the development unit 72 in this embodiment is lower in component cost, compared to a development unit which employs seals of the non-contact type, which are made up of a magnetic substance. That is, this embodiment can reduce a development unit in component cost.

In the case of this embodiment described above, the development unit 72 was structured so that as the first and second seals 91 and 92 are seen from the widthwise direction, they partially overlap with each other. This embodiment, however, is not intended to limit the present invention in scope in terms of the development unit structure. That is, all that is required is that the development unit 72 is structured so that as the first and second seals 91 and 92 are seen from the widthwise direction, no gap can be seen between the first and second seals 91 and 92 in terms of the direction R. For example, referring to part (b) of FIG. 4, the development unit 72 may be structured so that in terms of the direction R, the upstream end surface 91*b* of the first seal 91, and the downstream end surface 92*c* of the second seal 92 coincide with each other, in terms of the widthwise direction. Also in this case, as the developer 93 scatters outward in terms of the widthwise direction after being recovered by the first seal 91 by being conveyed in the circumferential direction of the first seal 91 by the development sleeve 49*y*, it comes into contact with the second seal 92, being therefore prevented from scattering further. Thus, the development unit 72 remains desirably sealed in terms of developer leakage.

Moreover, in this embodiment, the development unit 72 is structured so that the end surface 91*b* of the first seal 91, and the end surface 92*b* of the second seal 92, in terms of the direction R, are parallel to the widthwise direction. This embodiment, however, is not intended to limit the present invention in scope in terms of the orientation of the end surfaces 91*b* and 92*b*. For example, the development unit 72 may be structured so that at least one of the end surface 91*b* of the second seal 92 and the end surface 92*b* of the second seal 92 is slanted. In such a case, for example, referring to part (c) of FIG. 4, the development unit 72 may be structured so that the end surfaces 91*b* and 92*b* are angled in such a manner that as they are seen from the direction X, their upstream edges in terms of the direction R are positioned higher than their downstream edges. With the end surfaces 91*b* and 92*b* being tilted as described, as the developer 93 comes into contact with the end surfaces 91*b* and 92*b* from the upstream side in terms of the direction R, the developer 93 is guided by the end surfaces 91*b* and 92*b* inward of the development sleeve 49*y* in terms of the widthwise direction. Therefore, the first and second seals 91 and 92 can more effectively prevent the developer 93 from scattering into the internal space of the apparatus main assembly 10.

Moreover, in this embodiment, a seal of the so-called contact type was used as each of the first and second seals 91 and 92. However, this embodiment is not intended to limit the present invention in scope in terms of seal type. That is, the present invention is also applicable to a development unit which employs seals of the non-contact type, which are made up of a magnetic substance. With the employment of seals of the non-contact type, a development unit will be possibly better sealed than with the use of seals of the contact type.

According to the present invention, the development unit is structured so that the first seal is fixed to the main section of the housing of the development unit, which is on the outward side of the area where the distance between the cover section of the housing of the development unit, and the development sleeve is smallest. Therefore, it is unnecessary for a part of the main section of the housing of the development unit to be placed between the first seal 91 and the cover section of the housing of the development unit. Thus, it is possible to substantially reduce a developing device in size compared to a developing device structured so that the seal backing portion of the main section of its housing is placed between the first seal 91 and the cover section. Further, the second seal is staggered relative to the first seal in the circumferential direction of the development sleeve 49*y* by an amount which is substantial, but, not large enough to create a gap between the first and second seals as they are seen from the widthwise direction of the two seals. Therefore, a developing device in accordance with the present invention is capable of keeping developer in its development unit as well as a developing device, the first seal of which is backed up by the main section of its housing and extends into the area where the distance between the cover section of the housing and the development sleeve is smallest. That is, the present invention can provide a developing device which is substantially smaller in size than any conventionally structured developing device, and yet, can keep the end portions of its developer bearing component, sealed in terms of developer leakage, just as well as any conventionally structured developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-218546 filed on Oct. 27, 2014, which is hereby incorporated by reference herein in its entirety.

What is claimed is:

1. A developing apparatus comprising:

a developer carrying member configured and positioned to carry developer to develop a latent image;

a container body configured to accommodate the developer and to rotatably support said developer carrying member;

a covering member mounted on said container body and configured to cover a peripheral surface of said developer carrying member;

a first sealing member configured to seal one end portion of said developer carrying member;

a first supporting section configured to support said first sealing member, said first supporting section being provided in said container body and extending along a circumferential direction of said developer carrying member;

a second sealing member configured to seal said one end portion of said developer carrying member; and a second supporting section configured to support said second sealing member, said second supporting section being provided on said covering member and being disposed at a position corresponding to a position where said first supporting section is not provided, with respect to the circumferential direction of said developer carrying member;

wherein said first sealing member and said second sealing member are disposed so as not to overlap with each other as seen in the direction of a normal line of said developer carrying member from a rotation axis of said developer carrying member, and wherein said second sealing member is disposed at such a position that as seen in a rotational axis direction of said developer carrying member, said second sealing member is disposed so as to partly overlap with the said first sealing member with respect to the circumferential direction of said developer carrying member.

2. An apparatus according to claim 1, further comprising a regulating member configured and positioned to regulate a coating amount of the developer on said developer carrying member, wherein said second sealing member is disposed upstream of said first sealing member and downstream of said regulating member with respect to a rotational moving direction of said developer carrying member, and wherein as seen in a direction perpendicular to the rotational axis of said developer carrying member, a downstream end of said second sealing member overlaps with an upstream end of said first sealing member with respect to the rotational moving direction of said developer carrying member.

3. An apparatus according to claim 1, wherein an upstream end surface, with respect to the rotational moving direction of said developer carrying member, of at least one of said first sealing member and said second sealing member is provided with an inclined surface so as to guide the developer fed by said developer carrying member, axially inwardly of said developer carrying member.

4. An apparatus according to claim 1, wherein said covering member functions as a top cover of the container body.

5. An apparatus according to claim 1, further comprising a regulating member configured and positioned to regulate a coating amount of the developer on said developer carrying member, said regulating member is disposed below center of said developer carrying member.

6. An apparatus according to claim 1, wherein said first sealing member and said second sealing member are contact type sealing members contacting said developer carrying member to prevent leakage of the developer.

7. An apparatus according to claim 1, wherein said first sealing member and said second sealing member are disposed so as not to contact with each other.

* * * * *